US007883451B2

(12) United States Patent
Hand

(10) Patent No.: US 7,883,451 B2
(45) Date of Patent: Feb. 8, 2011

(54) METHODS OF APPLYING TREADLE STIMULUS

(75) Inventor: Richard A. Hand, Wilmington, NC (US)

(73) Assignee: Treadwell Corporation, Wilmington, NC (US)

( * ) Notice: Subject to any disclaimer, the term of this patent is extended or adjusted under 35 U.S.C. 154(b) by 0 days.

(21) Appl. No.: 11/729,561

(22) Filed: Mar. 29, 2007

(65) Prior Publication Data

US 2007/0243979 A1 Oct. 18, 2007

Related U.S. Application Data

(60) Provisional application No. 60/792,202, filed on Apr. 14, 2006.

(51) Int. Cl.
*A63B 23/10* (2006.01)
*A63B 21/22* (2006.01)

(52) U.S. Cl. ..... 482/80; 482/110; 601/27

(58) Field of Classification Search ..... 482/51, 482/52, 79, 53, 57, 63, 64, 65, 71, 74, 80, 482/110, 111, 145, 146, 147; 601/27, 29, 601/31, 32, 33, 34, 35; 112/217.1, 271.2, 112/217.3, 217.4

See application file for complete search history.

(56) References Cited

U.S. PATENT DOCUMENTS 954,756 A * 4/1910 McCabe ..... 112/217.1
1,160,986 A * 11/1915 Kiewicz ..... 474/89
1,226,804 A * 5/1917 Osius ..... 476/64
1,275,059 A * 8/1918 McCabe ..... 112/217.1
1,920,471 A * 8/1933 List et al. ..... 112/217.1
2,076,804 A * 4/1937 Winding ..... 280/221
2,148,919 A * 2/1939 Winding ..... 280/221
2,723,131 A * 11/1955 McChesney, Jr. ..... 280/221
3,007,280 A * 11/1961 Berberich ..... 446/252
3,186,366 A * 6/1965 Haas et al. ..... 112/275
3,318,304 A * 5/1967 Gurewich ..... 601/31
3,421,760 A 1/1969 Freeman, Jr. ..... 272/83
3,525,522 A 8/1970 Piller ..... 272/79
3,585,950 A * 6/1971 Ito ..... 112/275
3,638,940 A * 2/1972 Mehaulic ..... 482/51
3,688,710 A * 9/1972 Makihara et al. ..... 112/275
3,688,714 A * 9/1972 Makihara et al. ..... 112/275
3,741,540 A * 6/1973 Shimizu ..... 482/80
3,789,836 A * 2/1974 Girten ..... 601/31

(Continued)

FOREIGN PATENT DOCUMENTS

WO WO 9416775 A2 * 8/1994

*Primary Examiner*—Loan Thanh
*Assistant Examiner*—Daniel F Roland
(74) *Attorney, Agent, or Firm*—The Eclipse Group LLP; Kevin E. Flynn

(57) ABSTRACT

A treadle motion therapeutic device and a method of providing treadle motion therapy to a user which may be used as part of therapeutic modalities. The treadle motion therapy device adapted to receive at least one foot of a user in contact with a treadle such that the treadle pivots between a heel of the foot and a front portion of the foot to allow the user to move the treadle by using the front portion of the foot or by using the heel of the foot. The treadle motion therapy device having a capacity to store kinetic energy to assist in maintaining the treadling motion during a treadling session. Variations for other devices and methods are suggested.

6 Claims, 3 Drawing Sheets

U.S. PATENT DOCUMENTS 3,889,615 A * 6/1975 Uozake et al. ..... 112/292
3,991,693 A * 11/1976 Moran et al. ..... 112/275
4,185,622 A * 1/1980 Swenson ..... 601/27
4,222,127 A 9/1980 Donachy et al.
4,422,635 A 12/1983 Herod et al. ..... 272/96
4,501,421 A 2/1985 Kane et al. ..... 272/96
4,542,898 A * 9/1985 Grushkin ..... 482/71
4,862,875 A * 9/1989 Heaton ..... 601/26
4,921,243 A * 5/1990 Weidmann ..... 482/80
4,934,688 A * 6/1990 Lo ..... 482/53
5,035,421 A 7/1991 Scheller ..... 272/96
5,044,628 A * 9/1991 Bracci et al. ..... 482/79
5,147,281 A 9/1992 Thornton et al.
5,199,934 A * 4/1993 Lin ..... 482/79
5,211,613 A * 5/1993 Friesl ..... 482/58
5,242,340 A * 9/1993 Jerome ..... 482/52
5,292,294 A * 3/1994 Johnston ..... 482/51
5,299,993 A * 4/1994 Habing ..... 482/52
5,336,143 A * 8/1994 Wu ..... 482/52
5,336,146 A * 8/1994 Piaget et al. ..... 482/54
5,343,856 A * 9/1994 Proctor ..... 601/35
5,374,227 A * 12/1994 Webb ..... 482/52
5,433,684 A 7/1995 Carrillo ..... 482/80
5,577,985 A * 11/1996 Miller ..... 482/52
5,584,782 A * 12/1996 Szabo et al. ..... 482/52
5,643,153 A * 7/1997 Nylen et al. ..... 482/110
5,669,856 A * 9/1997 Liu ..... 482/51
5,709,631 A * 1/1998 Kleinsasser ..... 482/51
5,711,753 A 1/1998 Pacella et al.
5,733,227 A * 3/1998 Lee ..... 482/52
5,765,921 A 6/1998 Chuang ..... 297/423.46
5,769,760 A * 6/1998 Lin et al. ..... 482/52
5,800,315 A * 9/1998 Yu et al. ..... 482/57
5,816,818 A * 10/1998 Wun ..... 434/29
5,891,002 A 4/1999 Maki ..... 482/79
6,004,244 A * 12/1999 Simonson ..... 482/52
6,022,296 A * 2/2000 Yu ..... 482/52
6,190,289 B1 * 2/2001 Pyles et al. ..... 482/52
6,196,805 B1 3/2001 Reilley
6,217,488 B1 * 4/2001 Bernardson ..... 482/79
6,299,189 B1 * 10/2001 Chao ..... 280/220
6,402,173 B1 * 6/2002 Chiu ..... 280/252
6,405,585 B1 * 6/2002 Hewitt ..... 73/116.05
6,508,746 B1 * 1/2003 Jacobs et al. ..... 482/71
6,520,525 B1 * 2/2003 Yoon ..... 280/278
6,540,648 B1 * 4/2003 Chao ..... 482/57
6,569,213 B1 * 5/2003 Busch ..... 48/79
6,572,128 B2 * 6/2003 Graf ..... 280/221
6,641,506 B1 * 11/2003 Yang ..... 482/52
6,695,749 B2 * 2/2004 Kuo ..... 482/53
6,702,722 B1 * 3/2004 Arroyo, Jr. ..... 482/62
6,705,975 B2 3/2004 Kuo ..... 482/79
6,740,011 B1 5/2004 Tsai et al. ..... 482/80
6,758,825 B1 7/2004 Mathew ..... 601/5
6,808,476 B2 10/2004 Zagone ..... 482/80
6,821,235 B1 11/2004 Johnson et al. ..... 482/79
6,824,500 B2 * 11/2004 Park et al. ..... 482/51
6,849,035 B2 * 2/2005 Duvernay et al. ..... 482/60
6,855,093 B2 * 2/2005 Anderson et al. ..... 482/52
6,905,441 B2 * 6/2005 Anderson et al. ..... 482/52
6,929,553 B1 * 8/2005 Diemert ..... 472/118
7,004,885 B1 * 2/2006 Wu et al. ..... 482/4
7,033,306 B2 * 4/2006 Graber ..... 482/57
D527,060 S 8/2006 Flick et al.
7,097,593 B2 * 8/2006 Chang ..... 482/54
7,111,860 B1 * 9/2006 Grimaldos ..... 280/253
7,141,008 B2 * 11/2006 Krull et al. ..... 482/70
7,153,238 B2 * 12/2006 Anderson et al. ..... 482/52
7,160,231 B2 * 1/2007 Kazemi ..... 482/60
7,175,577 B2 * 2/2007 Greenspan et al. ..... 482/146
7,278,955 B2 * 10/2007 Giannelli et al. ..... 482/51
7,731,635 B2 * 6/2010 Dyer ..... 482/52
2002/0155926 A1 * 10/2002 Lat ..... 482/52
2002/0183663 A1 * 12/2002 Lu et al. ..... 601/28
2003/0017916 A1 * 1/2003 Juan ..... 482/51
2003/0022762 A1 * 1/2003 Jacobs et al. ..... 482/51
2003/0036462 A1 * 2/2003 Ravikumar et al. ..... 482/51
2003/0083177 A1 * 5/2003 Tung ..... 482/51
2004/0132582 A1 * 7/2004 Park et al. ..... 482/51
2004/0138028 A1 * 7/2004 Hsieh ..... 482/51
2004/0209740 A1 * 10/2004 Graber ..... 482/51
2005/0049116 A1 * 3/2005 Huang ..... 482/51
2005/0239606 A1 * 10/2005 Lin ..... 482/52
2005/0282687 A1 * 12/2005 Kazemi ..... 482/57
2005/0288156 A1 * 12/2005 Liao ..... 482/52
2006/0166791 A1 * 7/2006 Liao et al. ..... 482/52
2007/0087909 A1 * 4/2007 Mugica Miguel et al. ..... 482/57

* cited by examiner

METHODS OF APPLYING TREADLE STIMULUS

RELATED APPLICATIONS

This application claims benefit of a provisional application, Ser. No. 60/792,202, with a filing date of Apr. 14, 2006.

FIELD OF THE INVENTION

This invention is a foot and leg exercising device which provides medical benefits including exercise, increased circulation, range of motion benefits, and reduced foot and leg pain.

BACKGROUND OF THE INVENTION

The heart pumps blood throughout the extremities to provide essential oxygen and nutrients to the tissue in the extremities. The deoxygenated and waste product laden blood is then returned to the heart and internal organs for cleansing and oxygenation, and then is repumped to the body.

The return flow occurs, in part, due to the pressure generated in the veins, the pull of the right auricle of the heart, and through the milking effect of the muscle contractions in the extremities, particularly the "calf pump" mechanism of the lower extremities.

Muscle contractions that occur during activities of daily living facilitate this return flow of blood, but prolonged sitting or standing causes deoxygenated blood to stagnate. This leads to general fatigue and tired, heavy legs, and edema. Over a period of time, repetition of this cycle can lead to more serious conditions such as varicose veins, Restless Leg Syndrome, neuropathies, deep vein thrombosis, and leg ulcerations, to name a few.

In order to facilitate return blood flow a number of expedients have been employed. For those who are bedridden, intermittent external compression is used, primarily designed to prevent deep vein thrombosis. External compressive hose are often worn by those with leg circulatory issues.

Other devices have been proposed for physical therapy or exercise that utilize a foot pedal or treadle type arrangement, which allows a person a controlled exercise regimen using their feet and ankles to manipulate against a resistance foot pedal. For example in Kane et al., U.S. Pat. No. 4,501,421, a foot treadle device operates to provide a resistance force to the pivoting of foot plates. Shimizu, U.S. Pat. No. 3,741,540, discloses foot boards mounted for pivoting with springs providing resistance. A similar device is seen in Kuo, U.S. Pat. No. 6,705,975. It is has also been recognized that even passive motion, where no muscle activity from the user is required, may provide benefits. Matthew, U.S. Pat. No. 6,758,825, provides a foot pedal, with straps to secure the user's foot on the device, which is attached to a reciprocating motor. The motor rotates forcing a reciprocating rod in a circular motion, which is translated into an approximate linear motion for the foot pedal. This causes a back-and-forth motion for the foot. While the Matthew device is anticipated to have use in a variety of contexts, it is primarily designed for people who may have severe physical impairments, such as those confined to a wheelchair. The motor assisted motion prevents deterioration in muscles, which would otherwise be flaccid or unexercised because of some physical or nerve condition that prevents the patient from exercising those muscles themselves. The Matthew device facilitates blood flow in the veins and, therefore, may prevent deep venous thrombosis. Despite this earlier work, there is still an unmet need for a physical exercise device which is simple to construct, inexpensive to produce, can be widely distributed, be used in a wide variety of clinical, home, and office settings to produce high repetitions, without muscle fatigue, to purge the circulatory system of the legs.

SUMMARY OF THE INVENTION

The current invention utilizes a pivoting pedal. Ordinarily, this pedal would be large enough for a user to use one or two feet on the pedal at the option of a user. The pedal pivots back and forth. A user's foot on the pedal also pivots around the ankle joint. The foot pedal is attached at the end to a rod. This rod is mounted on the foot pedal for pivoting movement. At the end of the rod, opposite from its pivoting mount on the foot pedal, there is a connection to a rotating crank. Thus, as the foot pedal pivots about its mounting in the approximate midpoint as the rod moves, it rotates the crank shaft. The crank shaft is connected to a circular flywheel. This flywheel provides resistance. A user must work the foot pedal to overcome the inertia of the flywheel. The operative parts of the device are enclosed in a frame in order to stabilize the device and to provide a secure stationary mount for the rotating flywheel. The flywheel is enclosed in a protective frame or screen in order to prevent contact with the flywheel from the outside.

In use, a user will place one or both feet on the pivoting foot pedal, with the approximate pivot point of the ankle at or near a pivoting connection for the foot pedal. The user then may use either the toe or heel portion of the foot to press on the foot pedal. This starts a motion of the foot pedal which causes an arc-like vertical motion of the reciprocating rod. The reciprocating rod causes a circular motion for the rotating fly wheel. Because the flywheel will have significant mass, the inertial resistance of the flywheel must be overcome by the user. The user can then increase the rate of the rotation of the flywheel by increasing the rate of the manipulation of the foot pedal by the user's foot. This resultant movement, assisted by inertia, provides a unique form of exercise, a cross between active and active/assistive exercise. As a result, the user can perform hundreds or thousands of repetitions, engaging the calf pump mechanism and muscle contractions to facilitate return blood flow. This inertia assisted movement allows this apparatus to be used daily, or even multiple times daily, day after day, without the usual fatigue lactic acid buildup within the muscles.

DETAILED DESCRIPTION OF THE DRAWINGS

Figure 1:
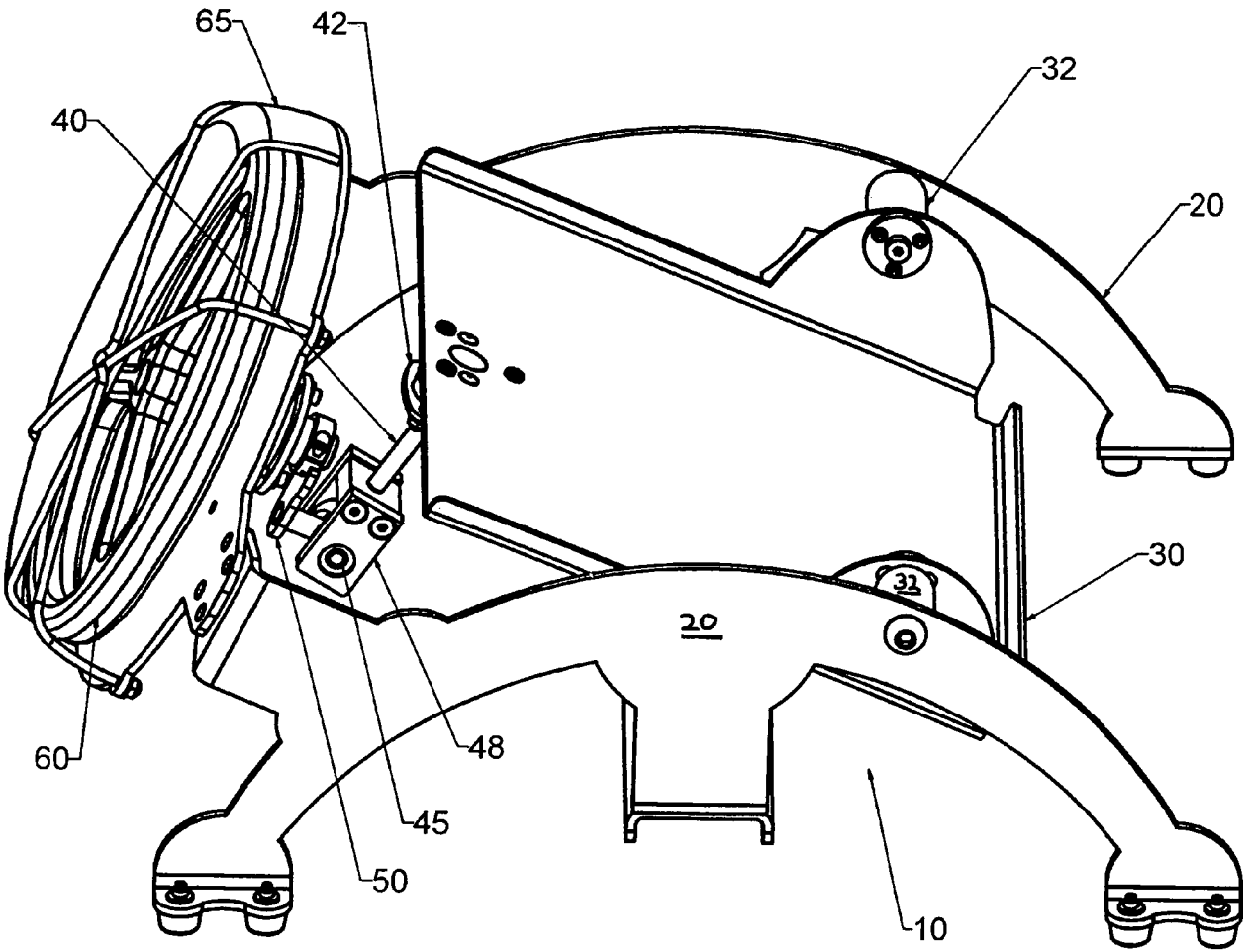
FIG. 1 is a view from above of the foot and leg exercising device.

FIG. 1 is a prospective view of the foot and leg exercising device (10). The foot pedal (30) is mounted for reciprocating motion on pedal mounts (32). The pedal mounts (32) are mounted on the frame (20). A push rod (40) is mounted to the foot pedal (30) by a spherical bushing (42). It is also connected to a rotating crank (50) at the end opposite of the pivot mount (42) by a trunion (45). The crank (50) is connected to the flywheel (60), which is seen inside of the flywheel cover (65). The flywheel cover (65) is attached to the foot pedal frame (20).

Figure 2:
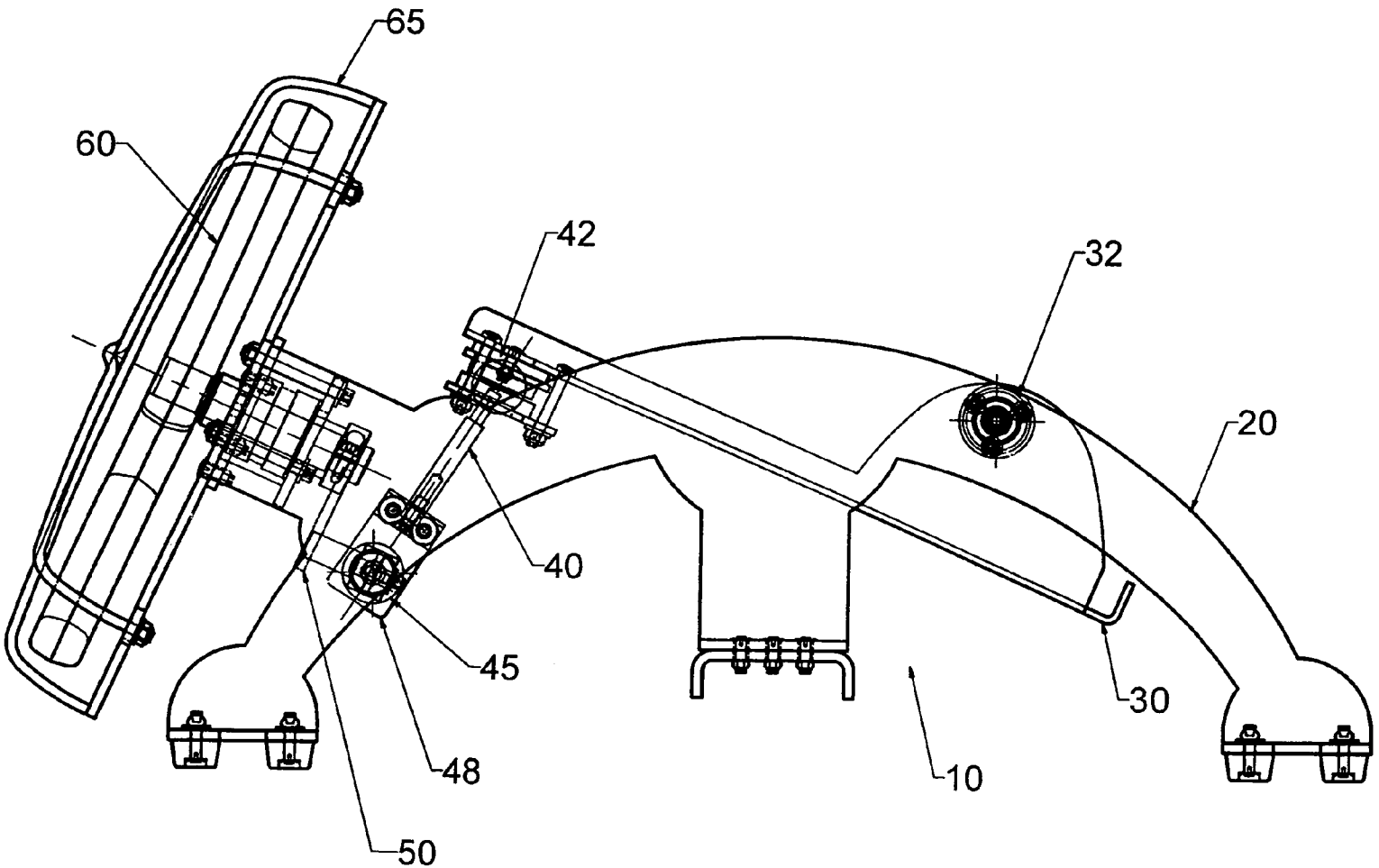
FIG. 2 is a side view seen in partial cut-a-way of the foot and leg exercising device.

FIG. 2 shows the foot and leg exercising device (10) in a partial cut-a-way side view, which better shows the operation of the crank (50), reciprocating rod (40), trunion (45), and yoke (48). The basic purpose of the crank (50), push rod (40), spherical bushing (42), trunion (45), and yoke (48) is to provide a connection between the foot pedal (30) and the flywheel (60). The foot pedal (30) pivots about the pedal mounts (32) in a short arc of motion. The arc of motion is short enough so that the motion of the foot pedal (30) at the point where the push rod (40) is mounted by the pivot mount (42) to the foot pedal (30) is approximately linear. Consequently, it is necessary to translate the approximate linear motion of the foot pedal (30) into a circular motion to drive the flywheel (60). There are a variety of expedients to translate the motion of the foot pedal (30) into the circular motion of the flywheel (60) and to also communicate the inertial force of the rotating flywheel (60) back to the foot pedal (30) to produce pivoting motion of the foot pedal (30) around the foot pedal mounts (32). As long as the method chosen is relatively safe, tends to reduce or minimize friction, and can be constructed at a reasonable cost, the exact mechanical connection between the foot pedal (30) and the flywheel (60) is a matter of choice among those of reasonable skill in the art. Here, the push rod (40) has a spherical end which fits into a spherical bushing (42) mounted to the foot pedal (30). This allows the push rod (40) a limited pivoting range of motion on the foot pedal (30) which is necessary as it drives the trunion (45) mounted on the yoke (48). The crank (50) is mounted to the trunion (45) with bearings within the trunion (45). The bearings are not seen in the drawings, but this allows the crank (50) to rotate within the trunion (45) as the trunion (45) is mounted on the yoke (48) for reciprocating motion on the push rod (40). Thus, as the push rod (40) moves up and down, it forces a circular motion of the crank (50). The motion could be either clockwise or counterclockwise, but, in any event, the circular motion produced by the crank (50) is communicated to the flywheel (60).

Figure 3:
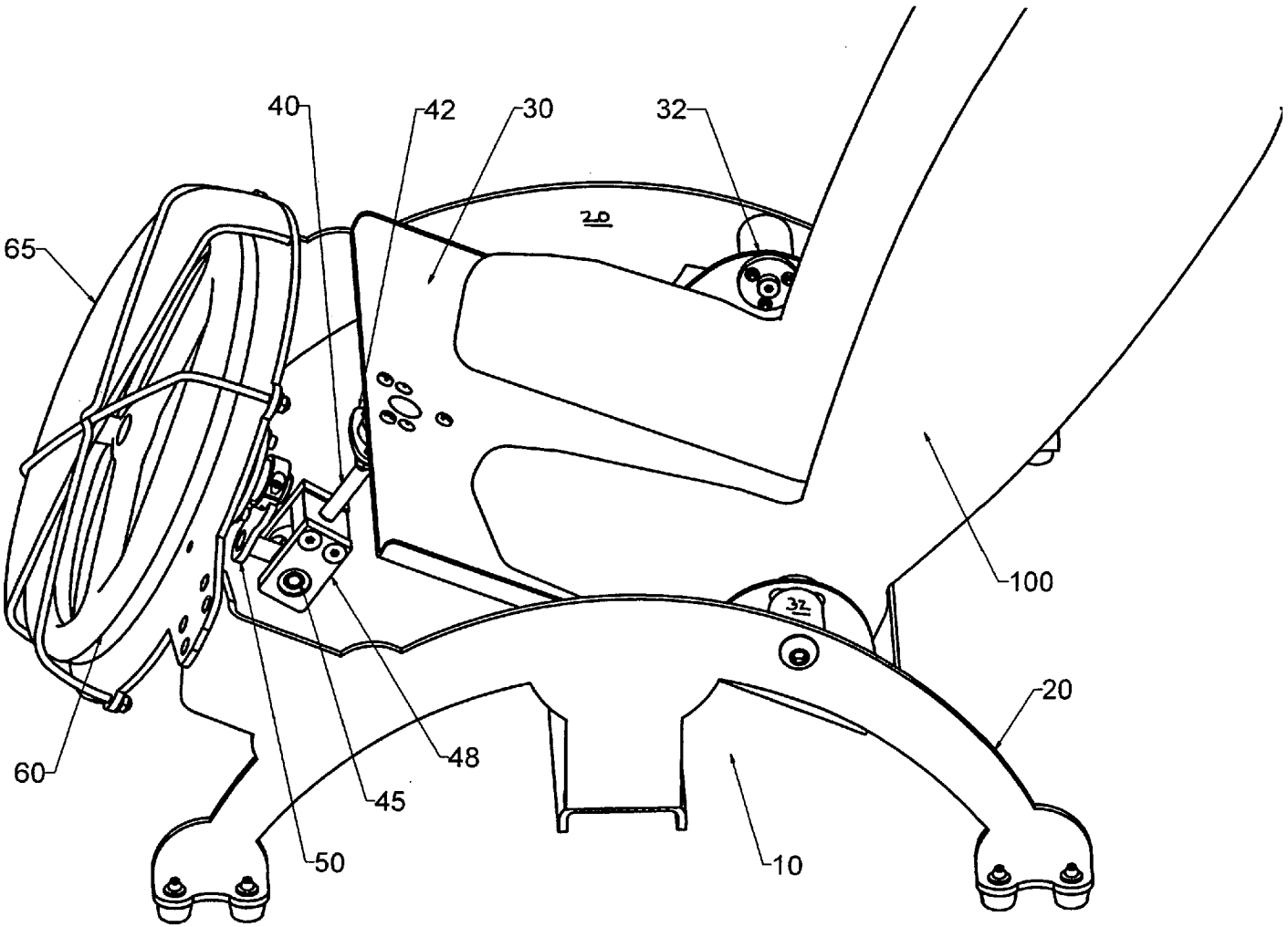
FIG. 3 is a view from above of the leg exercising device with the user's feet placed on the device.

FIG. 3 shows a user's feet (100) resting on the foot pedal (30). Here, the reciprocating rod (40) and the crank (50) are in the approximate six o'clock position, so a user would begin to operate the device by pressing down with the user's heel. This would force the heel portion of the foot pedal (30) downward. The foot pedal (30) pivots on the foot pedal mount (32) forcing the reciprocating rod (40) in an upward direction. Because the reciprocating rod (40) and the crank (50) are connected, either a clockwise or counterclockwise motion of the crank (50) results. As the reciprocating rod (40) and the crank (50) reach the approximate twelve o'clock position, the user may then press down with the toes. By alternately pressing down with the toe or the heel portion of the user's foot, a continuous circular motion is imparted to the flywheel (60). Initially, the resistance provided by the flywheel (60) would be the greatest because of friction and inertia. Once the flywheel (60) has reached a satisfactory rate of rotation, a user may then stop applying force with the heel or toe and simply rest one's feet (100) on the foot pedal (30). However, the foot pedal (30) motion will not stop immediately because the flywheel (60) has a significant mass and will continue to rotate because of inertial forces. In order to keep the flywheel (60) rotating, relatively little effort is required from a user. Here, the momentum of the flywheel 60) is assisting a user rather than resisting the user. Thus, this invention allows momentum assisted repetitions. Because the number of repetitions is assisted by the momentum of the flywheel (60), the user may perform high numbers of repetitions without muscle fatigue. The continuous motion provided by the inertial force of the flywheel results in a purge of the circulatory system in the area of the muscles being used. Because no continuous effort is required from the user, the user may rest between the period of time the user is required to impart momentum to a flywheel (60). This enables the user to perform a longer exercise program than would be the case without the momentum assisted repetitions. This is of benefit in special circumstances where a user may be impaired, have weak muscles, be morbidly obese, or in other ways that require assistance from the exercise device. However, the user can use the device to provide continuous resistance training by overcoming the resistance to the motion imparted by the inertial motion of the flywheel (60) as it circulates. If the user presses the toe downward when the flywheel (60) wishes to force the foot pedal (30) toe portion upward or using the heel to press downwardly on the heel portion of the foot pedal (30) when that overcomes the upward motion imparted by the flywheel (60).

Whether with or without resistance, this motion is beneficial to a user. First, it provides a range of motion for the foot and ankle, increasing flexibility. Second, it causes motion in the muscles of the ankle, foot, and leg, which promotes appropriate circulation and provides some benefit for increased strength even without resistance training. In this fashion, this device can be used as a physical therapy device for people with limited physical ability. It can also be used by normal people for resistance exercise. It can be used by people who are seated and wish to provide continuous circulatory assistance without constant or regular resistance or muscle effort. It has benefits for people who have Restless Leg Syndrome. It has shown to be of benefit to people who have peripheral diabetic neuropathy. It can also be used to warm up or cool down from more vigorous exercise. The device requires no plug or electrical outlets to operate. It is easily portable, can be placed under a desk or in an office. The flexibility, ease of use, and lack of effort required from a user has substantial benefits in promoting circulatory health in the extremities of the user and in purging the blood system in the area of use for a user.

I claim:

1. A method to enhance return blood flow from a user's leg by engaging a calf pump mechanism comprising:

(a) providing a frame;

(b) providing on said frame at least one foot pedal having a toe end for supporting a toe portion of a user's foot and a heel end for supporting a heel portion of the user's foot, and a pivot axis located intermediate the toe portion and the heel portion of the foot pedal;

(c) providing on said frame an inertia and momentum storage device having a mass that is freely movable on the frame in one direction of movement;

(d) connecting said foot pedal to said inertia and momentum storage device;

(e) using the toe portion and the heel portion of the user's foot to apply a force to said foot pedal and cause pivoting thereof about its pivot axis and to cause movement of said mass whenever the force applied to the foot pedal is greater than an inertia of said mass;

(f) using the inertia of the moving mass to cause pivotal movement of said foot pedal whenever the inertia of said moving mass is greater than the force applied to said foot pedal by the user; and (g) with the mass initially at rest, applying a force by the user to the foot pedal to cause pivoting of the foot pedal about its pivot axis through a plurality of repetitions of back and forth pivotal movements of the foot pedal to overcome the inertia of the mass at rest and to then gradually increase a speed of movement of the mass in said one direction of movement until the mass reaches a desired rate of speed; and (h) after the mass reaches the desired rate of speed, periodically eliminating the force applied to foot pedal by the user and utilizing the inertia of the moving mass to pivot the foot pedal through a plurality of back and forth repetitions and cause the user's foot to be moved by the pivotal movements of the foot pedal during each of the plurality of back and forth repetitions of the pivotal movements of the foot pedal and thereby purge a circulatory system of the user in an area of muscles of the user being used, and while the mass is moving, periodically applying a force to the foot pedal by the user through another plurality of repetitions to gradually increase the speed of movement of the mass, whereby the mass in maintained in constant motion both during the plurality of repetitions of back and forth pivotal movements of the foot pedal caused by the user and during the plurality of repetitions of back and forth pivotal movements of the foot pedal caused by the inertia of the moving mass;

wherein return blood flow from the user's leg is enhanced by engaging the calf pump mechanism

2. A method to enhance return blood flow from a user's leg by engaging a calf pump mechanism of claim 1 wherein said step of providing an inertia and momentum storage device further comprises providing at least one flywheel mounted for rotational movement on said frame.

3. A method to enhance return blood flow from a user's leg by engaging a calf pump mechanism of claim 2 wherein said method further comprises providing a safety screen to contain said flywheel to prevent injury from rapid rotational movement of said flywheel.

4. A method to enhance return blood flow from a user's leg by engaging a calf pump mechanism of claim 2 wherein said step of connecting said foot pedal to said inertia and momentum storage device further comprises connecting of said flywheel to said at least one foot pedal to provide passive motion to a user's foot without requiring work from a user by using inertia-stored in said inertia and momentum storage device.

5. A method to increase blood flow from a user's lower leg relative to blood flow from the user's lower leg when seated, stationary, and not treadling, comprising the steps of:

(a) mounting a freely rotatable flywheel having a mass for free rotation about its axis;

(b) mounting a foot pedal having a toe end for supporting a toe portion of the user's foot and a heel end for supporting a heel portion of the user's foot, and a pivot axis located intermediate the toe portion and the heel portion of the foot pedal;

(c) applying a force by the user to the foot pedal to move the foot pedal back and forth about the pivot axis when the toe portion and heel portion of the user's foot are applied to the toe end and the heel end of the foot pedal, respectively;

(d) using a back and forth pivotal movement of the foot pedal to cause rotation of the flywheel in one direction of rotation whenever the force applied by the user to the foot pedal is greater than an inertia of the flywheel and using the rotation of the flywheel mass to cause back and forth pivotal movement of the foot pedal whenever the inertia of the flywheel mass is greater than the force applied by the user to the foot pedal;

(e) with the flywheel initially at rest, applying a force by the user to the foot pedal to move the foot pedal back and forth about the pivot axis to overcome the inertia of the flywheel at rest and to then increase a rotational speed of the flywheel in said one direction of rotation until the flywheel reaches a desired rate of rotation; and after the flywheel reaches the desired rate of rotation, periodically eliminating the force applied by the user to the foot pedal and utilizing the inertia of the rotating flywheel mass to cause a first plurality of back and forth pivotal movements and thereby cause the user's foot to be moved by the pivotal movements of the foot pedal during each of the plurality of back and forth pivotal movements of the foot pedal, and while the flywheel is rotating periodically applying a force by the user to the foot pedal to move the foot pedal back and forth through a second plurality of back and forth pivotal movements to increase the rotational speed of the flywheel; and (g) maintaining the flywheel in constant motion in said one direction of rotation during the first and second plurality of back and forth pivotal movements;

wherein blood flow from a user's lower leg is increased relative to blood flow from the user's lower leg when seated, stationary, and not treadling.

6. A method to increase blood flow from a user's lower leg relative to blood flow from the user's lower leg when seated, stationary, and not treadling as defined in claim 5, wherein the user is seated while applying a force by the user to the foot pedal to move the foot pedal back and forth and while the inertia of the flywheel is causing the user's foot to be moved by the pivotal movements of the foot pedal.

* * * * *

UNITED STATES PATENT AND TRADEMARK OFFICE

CERTIFICATE OF CORRECTION

PATENT NO. : 7,883,451 B2
APPLICATION NO. : 11/729561
DATED : February 8, 2011
INVENTOR(S) : Richard A. Hand It is certified that error appears in the above-identified patent and that said Letters Patent is hereby corrected as shown below:

In column 5, claim 1, lines 17-18, please replace the words “in maintained in” with -- is maintained in --.

In column 5, claim 1, line 24, at the end of claim 1 please add a -- . -- after the word “mechanism”.

In column 5, claim 4, line 42, please replace the words “inertia-stored” with the words -- inertia stored --.

Signed and Sealed this
Tenth Day of May, 2011

David J. Kappos

David J. Kappos
*Director of the United States Patent and Trademark Office*